US005655229A

United States Patent [19]

Horn

[11] Patent Number: 5,655,229

[45] Date of Patent: Aug. 12, 1997

[54] PORTABLE URINAL DEVICE FOR BEDSIDE AND TRAVEL USE

[76] Inventor: Marlon Horn, P.O. Box 24870, Los Angeles, Calif. 90024

[21] Appl. No.: 517,367

[22] Filed: Aug. 21, 1995

[51] Int. Cl.[6] ..... A47K 11/12

[52] U.S. Cl. ..... 4/144.3; 4/144.1

[58] Field of Search ..... 4/144.1, 144.3

[56] References Cited

U.S. PATENT DOCUMENTS

| | | | |
|---|---|---|---|
| 0,137,214 | 3/1873 | Knight et al. | 4/144.3 |
| 3,000,015 | 9/1961 | Hart | 4/144.3 |
| 4,189,789 | 2/1980 | Hofstetter | 4/144.1 |
| 4,202,058 | 5/1980 | Anderson | 4/144.3 |
| 4,285,077 | 8/1981 | Braxton | 4/144.1 X |
| 4,631,061 | 12/1986 | Martin | 4/144.1 X |

FOREIGN PATENT DOCUMENTS

| | | | |
|---|---|---|---|
| 1236346 | 6/1960 | France | 4/144.3 |

*Primary Examiner*—Robert M. Fetsuga

[57] ABSTRACT

A portable urinal device for bedside and travel use including a urine collection funnel for collecting a urine stream expelled by a user having a substantially conically shaped spout with a wide open inboard end, a narrow open outboard end, an intermediate tapered portion therebetween, and a flow passage extended between the ends and through the intermediate portion; a urine collection bottle having an open mouth; and a urine transfer hose having an upper proximal end removably secured to the outboard end of the urine collection funnel and a lower distal end disposed within the mouth of the bottle for transferring the urine stream from the urine collection funnel to the urine collection bottle.

1 Claim, 5 Drawing Sheets

PORTABLE URINAL DEVICE FOR BEDSIDE AND TRAVEL USE

BACKGROUND OF THE INVENTION

1. Field of the Invention

The present invention relates to a portable urinal device for bedside and travel use and more particularly pertains to allowing a user to urinate when toilet facilities are unavailable or unreachable with a portable urinal device for bedside and travel use.

2. Description of the Prior Art

The use of urinating apparatuses is known in the prior art. More specifically, urinating apparatuses heretofore devised and utilized for the purpose of allowing a user to urinate are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,419,913 to Crosby discloses a urinal device with disposable container. U.S. Pat. No. 3,654,638 to Nye discloses an output commode pan. U.S. Pat. No. 3,806,967 to Sato discloses a toilet utensil. U.S. Pat. No. 3,928,875 to Persson discloses a throw-away receptacle for collection of urine of those confined to bed. U.S. Pat. No. 4,309,779 to Knight discloses personal urinal devices usable by males and females. U.S. Pat. No. 5,309,580 to Amalsad et al. discloses a combination portable children's toilet and toilet trainer.

While these devices fulfill their respective, particular objective and requirements, the aforementioned patents do not describe a portable urinal device for bedside and travel use that is portable in design, is usable by both male and female users, and features a filter for removing an unpleasant scent from a user-expelled urine stream.

In this respect, the portable urinal device for bedside and travel use according to the present invention substantially departs from the conventional concepts and designs of the prior art, and in doing so provides an apparatus primarily developed for the purpose of allowing a user to urinate when toilet facilities are unavailable or unreachable.

Therefore, it can be appreciated that there exists a continuing need for new and improved portable urinal device for bedside and travel use which can be used for allowing a user to urinate when toilet facilities are unavailable or unreachable. In this regard, the present invention substantially fulfills this need.

SUMMARY OF THE INVENTION

In the view of the foregoing disadvantages inherent in the known types of urinating apparatuses now present in the prior art, the present invention provides an improved portable urinal device for bedside and travel use. As such, the general purpose of the present invention, which will be described subsequently in greater detail, is to provide a new and improved portable urinal device for bedside and travel use and method which has all the advantages of the prior art and none of the disadvantages.

To attain this, the present invention essentially comprises, in combination, a urine collection funnel for collecting a urine stream expelled by a user. The urine collection funnel is formed of a soft and generally flexible rubber material. The urine collection funnel has a conically shaped spout with a wide open inboard end, a narrow open outboard end, an intermediate tapered portion therebetween, a flow passage extended between the ends and through the intermediate portion, and a flange portion extending peripherally outwards from the inboard end. The flange portion of the urine collection funnel is positionable in a juxtaposed relation with a lower pelvic area of the user for directing the urine stream into the spout. The flange portion of the urine collection funnel is further formed of a concave member with a substantially C-shaped cross section having an exterior surface, an interior surface, and a periphery interconnecting the surfaces formed of an upper edge, a lower edge with a length greater than that of the upper edge, and a pair of side edges extended therebetween and with each side edge having a length greater than the lower edge. Each side edge of the member additionally has an elongated integral rib formed therealong and extended outwards in a perpendicular fashion from the interior surface. The ribs are used for preventing overspray of the urine stream from escaping from the urine collection funnel. The intermediate portion of the spout further has a charcoal-impregnated and annular filter secured thereto. The filter has an inner extent that is placed in communication with the flow passage such that an unpleasing scent is removed from the urine stream as it flows through the filter.

A plastic urine collection bottle is provided. The urine collection bottle has a lower tubular body with a hollow interior, an outwardly threaded and tubular open mouth positioned in axial alignment with the body portion, and a neck extended therebetween. The urine collection bottle further has an inwardly threaded cap that is threadedly secured over the mouth and an axial bore disposed through an upper extent of the cap for allowing access to the interior.

A flexible rubber urine transfer hose is included and has an upper proximal end removably secured to the outboard end of the urine collection funnel and a lower distal end removably secured within the bore of the cap. The urine transfer hose is used for transferring the urine stream from the urine collection funnel to the urine collection bottle.

In addition, a flexible rubber band is provided and has one end coupled to the upper edge of the urine collection funnel and another end coupled to the lower edge of the collection funnel to thereby create a closed loop configuration for allowing the urine collection funnel to be hung from a recipient object. A rigid stand is also included and has a base, an upstanding pole with a lower end coupled to the base, and a hook coupled to an upper end of the pole. The urine collection funnel is hangable from the hook through use of the band.

Lastly, a cloth traveling bag is provided for holding the urine collection funnel, urine collection bottle, and urine transfer tube therein for portable transport from one location to another. The bag has a generally hollow rectangular box-shaped body with an open top, a lid hingably coupled to the body and removably securable over the opening, and a strap coupled to the body to thereby create a closed loop configuration for allowing the bag to be carried by a user.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable urinal device for bedside and travel use which has all the advantages of the prior art urinating apparatuses and none of the disadvantages.

It is another object of the present invention to provide a new and improved portable urinal device for bedside and travel use which may be easily and efficiently manufactured and marketed.

It is a further object of the present invention to provide a new and improved portable urinal device for bedside and travel use which is of durable and reliable construction.

An even further object of the present invention is to provide a new and improved portable urinal device for bedside and travel use which is susceptible of a low cost of manufacture with regard to both materials and labor, and which accordingly is then susceptible of low prices of sale to the consuming public, thereby making such a portable urinal device for bedside and travel use economically available to the buying public.

Still yet another object of the present invention is to provide a new and improved portable urinal device for bedside and travel use which provides in the apparatuses and methods of the prior art some of the advantages thereof, while simultaneously overcoming some of the disadvantages normally associated therewith.

Even still another object of the present invention is to provide a new and improved portable urinal device for bedside and travel use for allowing a user to urinate when toilet facilities are unavailable or unreachable.

Lastly, it is an object of the present invention to provide a new and improved portable urinal device for bedside and travel use comprising a urine collection funnel for collecting a urine stream expelled by a user having a substantially conically shaped spout with a wide open inboard end, a narrow open outboard end, an intermediate tapered portion therebetween, and a flow passage extended between the ends and through the intermediate portion; a urine collection bottle having an open mouth; and a urine transfer hose having an upper proximal end removably secured to the outboard end of the urine collection funnel and a lower distal end disposed within the mouth of the bottle for transferring the urine stream from the urine collection funnel to the urine collection bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
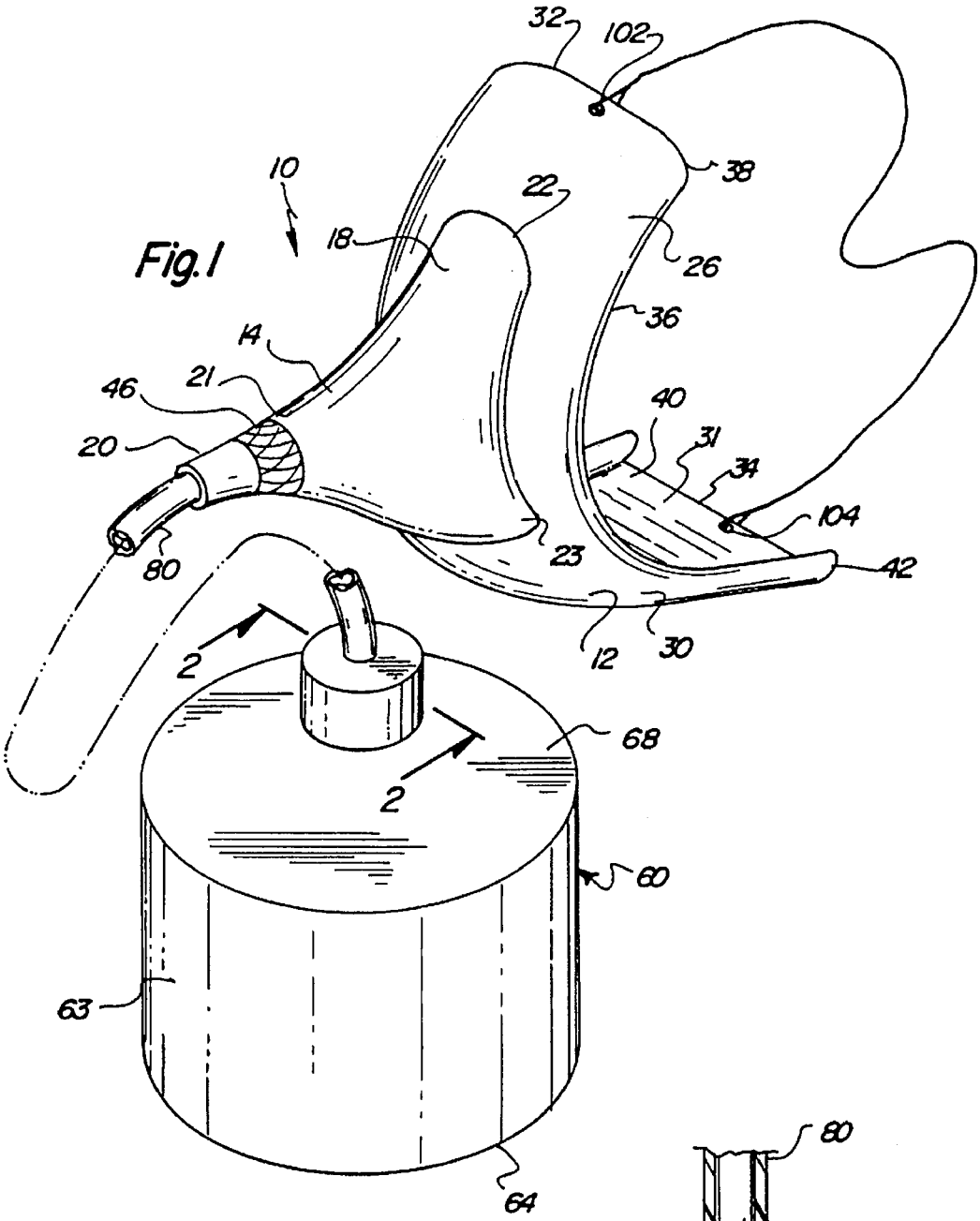
FIG. 1 is a perspective view of the preferred embodiment constructed in accordance with the principles of the present invention.
Figure 2:
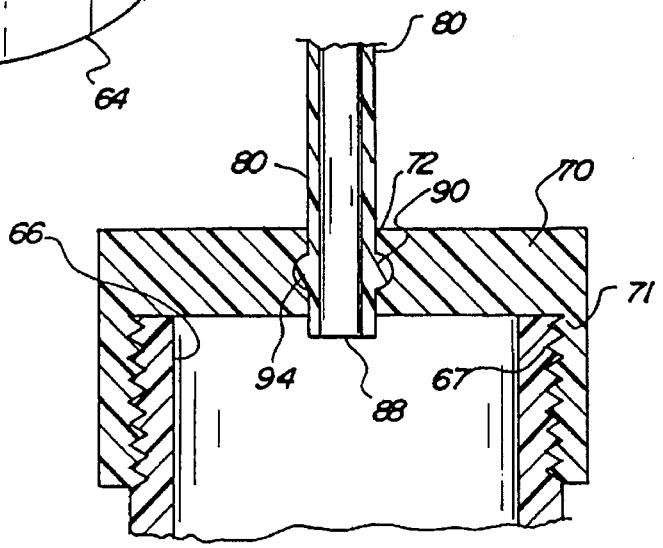
FIG. 2 is a cross-sectional view of the present invention taken along the line 2—2 of FIG. 1.
Figures 3, 4:
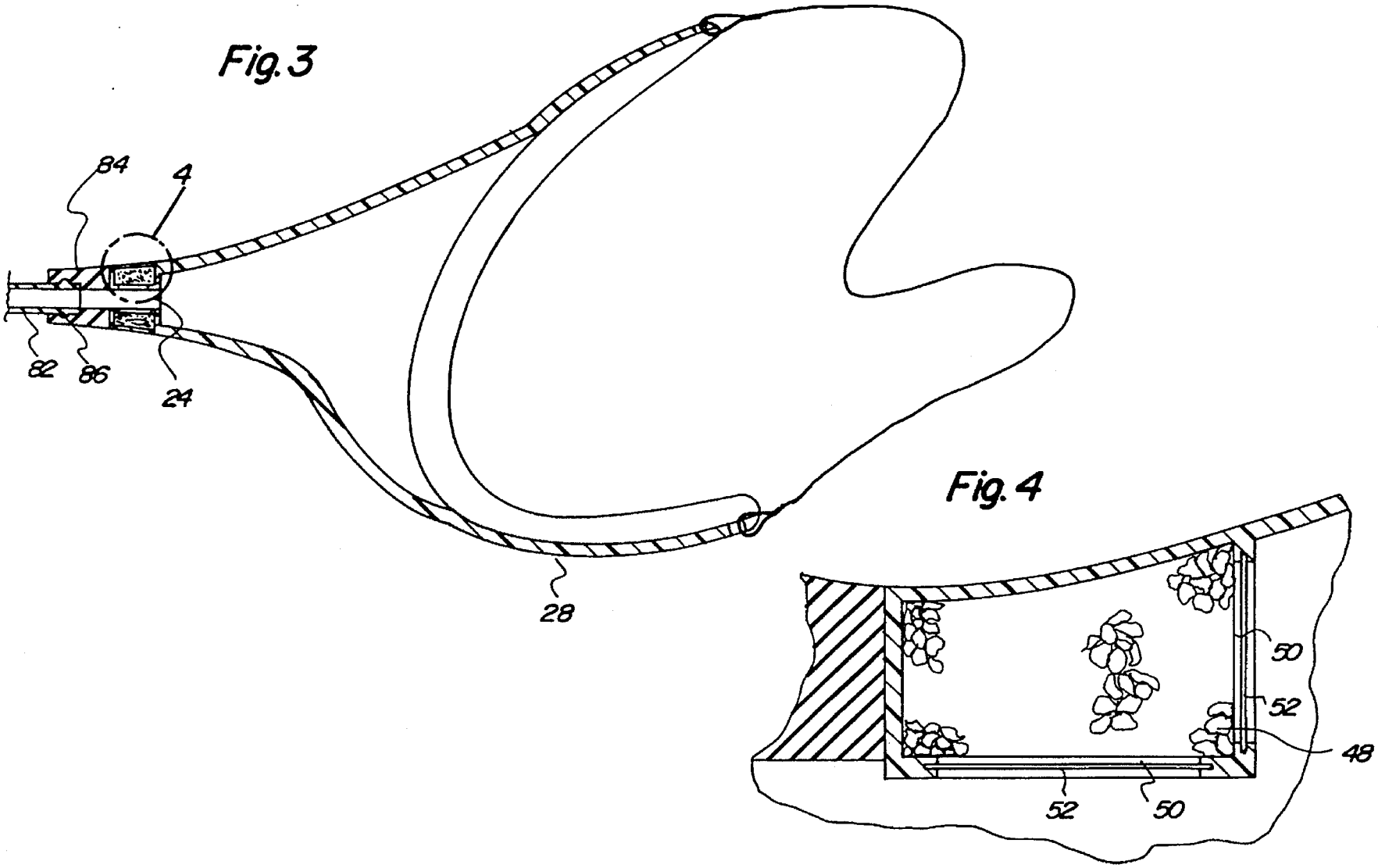
FIG. 3 is a cross-sectional view of the urine collection funnel of the present invention for use by either a male or a female.
FIG. 4 is an enlarged cross-sectional view of a portion of the odor filter of the present invention.

With reference now to the drawings, and in particular, to FIG. 1 thereof, the preferred embodiment of the new and improved portable urinal device for bedside and travel use embodying the principles and concepts of the present invention and generally designated by the reference number 10 will be described.

The preferred embodiment of the present invention comprises a plurality of components. In their broadest context, such components include a urine collection funnel, a urine collection bottle, a urine transfer hose, a stand, and a traveling bag. Such components are individually configured and correlated with respect to each other to provide a portable structure that allows a user to urinate when toilet facilities are unavailable.

Specifically, the present invention includes a urine collection funnel 12 that can be operated by either a male or female user. The urine collection funnel is used for collecting a urine stream expelled by the user. The urine collection funnel is formed of a soft and generally flexible rubber or plastic material. Funnel 12 has a conically-shaped spout 14 with a wide open inboard end 18, a narrow open outboard end 20, and an intermediate tapered portion 22 therebetween. The inboard end 18 is terminated at an edge extent that has a generally triangular-shaped cross-sectional configuration formed of a rounded upper portion 22 and a pair of generally pointed lower portions 23. Such a configuration creates a cup for capturing and directing the flow of the urine stream. A flow passage 24 is extended between the ends 18, 20 and through the intermediate portion 22. The urine collection funnel is positioned such that the inboard end is held above the outboard end when in use. In addition, a flange portion 26 is provided. The flange portion is coupled to and extended peripherally outwards from the edge extent of the inboard end 18. Flange portion 26 is positionable in a juxtaposed relation with a lower pelvic area of the user for further ensuring that the urine stream from the male or female user is properly directed into the spout 14. The flange portion is formed of a concave member 28 with a substantially C-shaped cross-section. Concave member 28 has an exterior surface 30, an interior surface 31, and a periphery interconnecting the surfaces. The periphery is formed of an upper edge 32, a lower edge 34, and a pair of side edges 36 extended therebetween. The lower edge 34 has a length greater than that of the upper edge, and each side edge has a length greater than the lower edge. The periphery also includes a pair of upper rounded corners 38 and a pair of lower squared-off corners 40. The corners allow for a comfortable and snug fit of the flange portion against a user. Each side edge 36 additionally has an elongated and integral rib 42 formed therealong. Each rib is extended outwards in a substantially perpendicular fashion from the interior surface 31. The ribs are used for preventing overspray generated by the urine stream from escaping from the urine collection funnel 22. Lastly, the intermediate portion of the spout 14 has an annular perforated plastic filter 46 secured thereto impregnated with charcoal 48 or a fragranced masking agent. The filter has an inner extent placed in communication with the flow passage 24 through slots 50 that are each covered with a permeable fabric material 52. An unpleasing scent is removed from the urine stream by the charcoal as it flows through the filter. Alternatively, the fragranced masking agent can be used in lieu of the charcoal for masking the scent of urine with a pleasing smell.

A urine collection bottle 60 is also provided. The urine collection bottle is formed of plastic or other similar rigid material. Bottle 60 has a lower tubular body 62 with a hollow interior bounded by a peripheral side wall 63 and a circular planar bottom wall 64. The bottle 60 also has a tubular and open mouth 66 with outwardly extending threads 67 formed thereon. The mouth is positioned in axial alignment with the body. In addition, a neck 68 is extended between and coupled to the body and the mouth. Furthermore, the urine collection bottle has a cap 70 with inwardly extending threads 72 formed thereon. The cap is threadedly and removably secured over the mouth of the bottle. An axial bore 72 is disposed through an upper extent of the cap for allowing access to its interior.

A flexible rubber urine transfer hose 80 is used for transferring the urine stream from the urine collection funnel to the urine collection bottle for subsequent disposal. The urine transfer hose has an upper proximal end 82 that is removably secured to the outboard end 20 of the urine collection funnel with a fastener. The fastener is composed of a pair of diametrically opposed and integral protrusions formed on the upper end 82 that are mated within a pair of diametrically opposed detents 86 formed on the outboard end. The hose also has a lower distal end 88 that is removably secured within the bore 72 of the cap with another fastener. This fastener is also composed of a pair of diametrically opposed and integral protrusions 90 formed on the lower end 88 that are mated with a pair of diametrically positioned detents 94 formed on the upper extent of the cap at a location adjacent to bore 72.

The urine collection funnel 12 also includes a flexible elongated rubber band 100. The rubber band has one end coupled in a loop to the upper end of the urine collection funnel through a hole 102 and another end coupled in a loop to the lower edge of the urine collection funnel through another hole 104. The coupling of the rubber band to the funnel 12 creates a closed loop configuration that allows the funnel to be hung from an external recipient object.

A rigid metal stand is provided. The stand has a base 110 with legs positioned in a tripod arrangement. The base also has an upstanding pole 114 with a lower end coupled to a central portion of the base. A hook 116 is coupled to an upper end of the pole. The urine collection funnel 12 is hangable from the hook through use of the band 100.

Lastly, a traveling bag 120 is used for holding the urine collection funnel 12, urine collection bottle 60, and urine transfer tube 80 therein. The traveling bag is formed of cloth, leather, or other similar suitable material. The traveling bag allows for portable transport of the cup, funnel, and bottle from one location to another. The bag has a generally hollow, rectangular, and box-shaped body 122 with an open top, a lid 114 hingably coupled to the body and removably securable over the opening with a snap fastener 116, and a strap coupled to the body to thereby create an upwardly positionable and closed loop configuration. The strap allows the bag to be readily carried by a user from one location to another.

Figure 6:
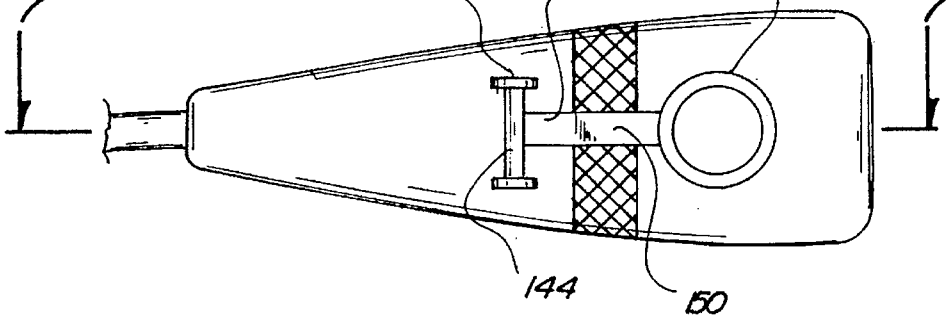
FIG. 6 is a plan view of the urine collection funnel of the alternate embodiment of the present invention taken along line 6—6 of FIG. 5.
Figure 5:
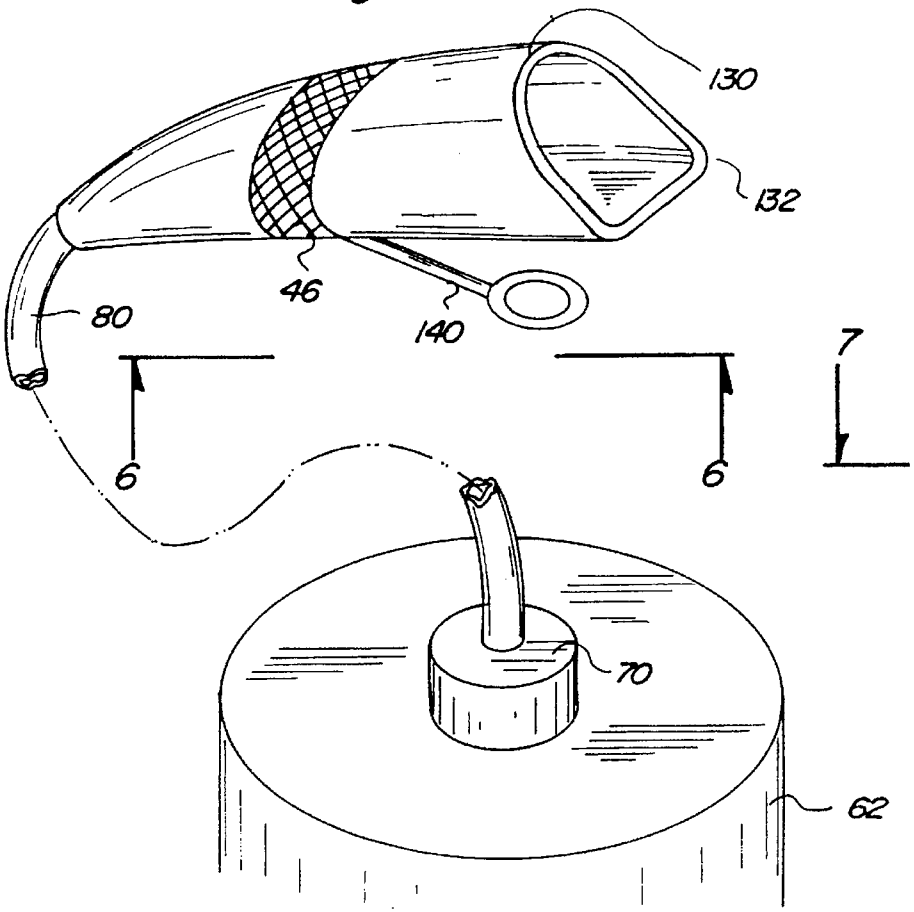
FIG. 5 is perspective view of an alternate embodiment of the urine collection funnel that is specifically designed for use by a male.
Figure 7:
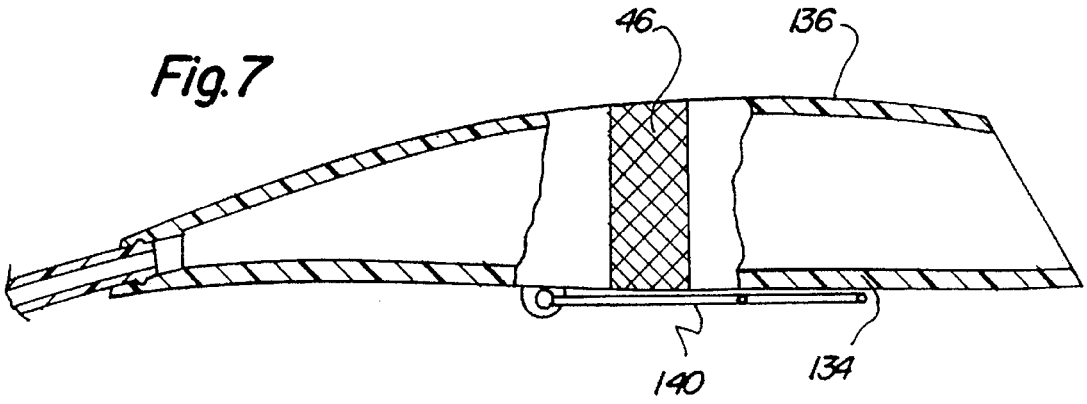
FIG. 7 is a cross-sectional view of the urine collection funnel of the alternate embodiment of the present invention.
Figure 8:
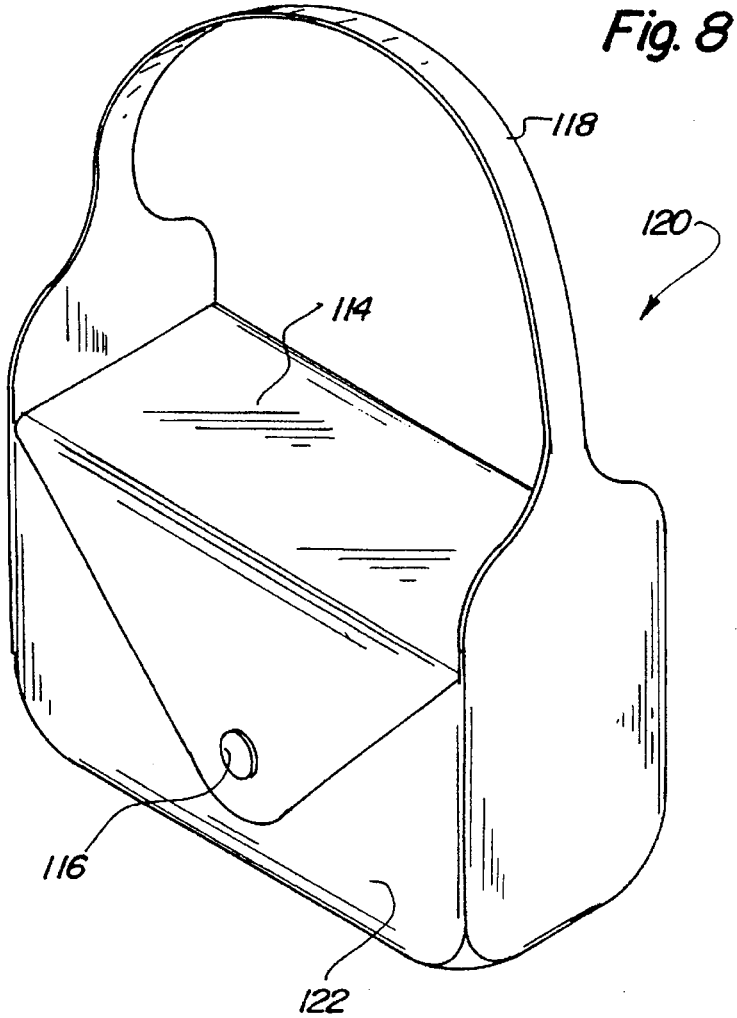
FIG. 8 is a perspective view of the portable travel bag for carrying the urine collection funnel, urine collection bottle, and urine transfer hose from one location to another.
Figure 9:
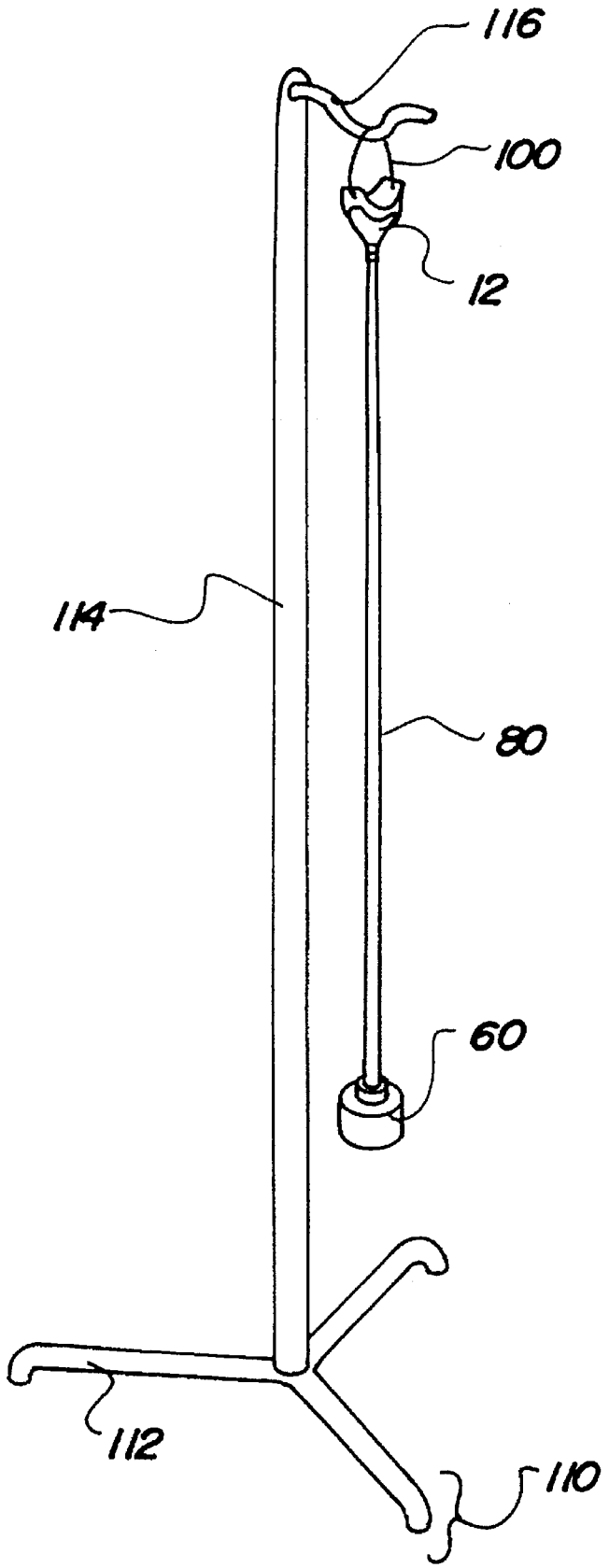
FIG. 9 is a perspective view of an optional stand that is used for hanging the present invention at a proximal accessible location such as a bedside.

A second embodiment of the present invention is shown in FIGS. 5–7 and includes substantially all of the components of the present invention except that the urine collection tube 12 is shaped to substantially conform with an outer surface of a male user's penis to thereby create an elongated member 130. In addition, the inboard end 132 is tapered at an angle with respect to a central axis that passes through the member 130. As shown in FIG. 7, the cross-section of the member 130 also has a flat lower extent 134 and a curved upper extent 136. A rigid plastic hook 140 is provided and used for hanging the member 130 from an external recipient object. The hook has an inboard end 142 that is pivotally coupled to the urine collection tube by a rod 144 secured with eyelets 146 and an outboard end formed in a circular loop 148. An intermediate elongated portion 150 is extended between the ends. In addition, as in the preferred embodiment, the member 130 also has a filter 46 for removing urine scent from the user's urine stream.

What has been described is a small durable compact portable toilet or urinal device that is easy to operate, easy to move, easy to clean, easy to store, and comfortable to use. The present invention will be beneficial to men, women and children who are ill or able-bodied. The preferred embodiment of the present invention consists of a urine collection funnel manufactured in one standard size or in sizes of small, medium, and large. A flexible plastic hose manufactured in one standard size and length is utilized. A urine collection bottle or container is also provided and can be fashioned in pint-size, quart-size, or gallon-size capacities or the like. To operate the present invention, the user simply presses the open inboard end of the urine collection funnel up against or near the urinating orifice of his or her body. The urine stream is deposited in the funnel and then freely flows through its passage and the through the hose to the bottle. The present invention is formed of an inexpensive plastic or rubber material and is easily and inexpensively manufactured. The present invention provides the user the knowledge and confidence that their body function needs can be fulfilled without worry or anxiety. Thus, the present invention allows users the capability to relieve themselves without having to leave their beds, cars, wheelchairs or the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A portable urinal device for bedside and travel use for allowing a user to urinate when toilet facilities are unavailable or unreachable comprising, in combination:

a urine collection funnel for collecting a urine stream expelled by a user, the urine collection funnel formed of smooth durable lightweight plastic or rubber with soft and generally flexible rubber material around the wide open inboard end terminating at an edge extent which has a generally triangular-shaped cross-sectional configuration formed of a rounded upper portion and a pair of pointed lower portions thereby creating a cup for capturing and directing the flow of the urine stream, a conically shaped spout with a wide open inboard end, a narrow open outboard end, an intermediate tapered portion therebetween, a flow passage extended between the ends and through the intermediate portion, and a flange portion extending peripherally outwards from the inboard end that is positionable in a juxtaposed relation with a lower pelvic area of the user for directing the urine stream into the spout, the flange portion further formed of a concave member with a substantially C-shaped cross section having an exterior surface, an interior surface, and a periphery interconnecting the surfaces formed of an upper edge, a lower edge with a length greater than that of the upper edge, and a pair of side edges extended therebetween and with each side edge having a length greater than the lower edge and a pair of upper rounded corners and lower squared-off corners, each side edge additionally having an elongated integral rib formed therealong and extended outwards in a perpendicular fashion from the interior surface and with the ribs used for preventing overspray of the urine from escaping from the urine collection funnel, the intermediate portion of the spout further having a charcoal-impregnated and annular filter secured thereto and with the filter having an inner extent with slots covered with a permeable fabric placed in communication with the flow passage such that an unpleasing scent is removed from the urine stream as it flows through the filter;

a plastic urine collection bottle having a lower tubular body with a hollow interior bounded by a peripheral side wall and a circular bottom wall, an outwardly threaded and tubular open mouth positioned in axial alignment with the body portion, and a neck extended therebetween, the urine collection bottle further having an inwardly threaded cap that is threadedly secured over the mouth and an axial bore disposed through an upper extent of the cap for allowing access to the interior;

a flexible rubber urine transfer hose having an upper proximal end removably secured to the outboard end of the urine collection funnel via a fastener composed of a pair of diametrically opposed and integral protrusions formed on the upper proximal end that are mated with in a pair of diametrically opposed detents formed on the outboard end of the urine collection funnel and a lower distal end removably secured within the bore of the cap via a fastener composed of a pair of diametrically opposed and integral protrusions formed on the lower distal end that are mated with in a pair of diametrically opposed detents formed on the cap and with the urine transfer hose used for transferring the urine stream from the urine collection funnel to the urine collection bottle;

a flexible rubber band having one end coupled to the upper edge of the urine collection funnel and another end coupled to the lower edge of the collection funnel to thereby create a closed loop configuration for allowing the urine collection funnel to be hung from a recipient object;

a rigid metal stand having a base, an upstanding pole with a lower end coupled to the base, and a hook coupled to an upper end of the pole and with the urine collection funnel hangable from the hook through use of the band; and a cloth traveling bag for holding the urine collection funnel, urine collection bottle, and urine transfer tube therein for portable transport from one location to another, the bag having a generally hollow rectangular box-shaped body with an open top, a lid hingably coupled to the body and removably securable over the opening, and a strap coupled to the body to thereby create a closed loop configuration for allowing the bag to be carried by a user.

* * * * *